United States Patent [19]

Lorber et al.

[11] Patent Number: 4,586,712

[45] Date of Patent: May 6, 1986

[54] AUTOMATIC SHUFFLING APPARATUS

[76] Inventors: Harold Lorber; Ronald B. Lorber, both of 3225 Burn Brae Dr., Dresher, Pa. 19025; Lee H. Loeb; Jeffrey C. Loeb, both of 22 Woodlyn Ave., Norristown, Pa. 19403

[21] Appl. No.: 417,885

[22] Filed: Sep. 14, 1982

[51] Int. Cl.[4] ..... A63F 1/12

[52] U.S. Cl. ..... 273/149 R; 221/224

[58] Field of Search ..... 273/149 R; 221/224, 221/225, 233, 265

[56] References Cited

U.S. PATENT DOCUMENTS 4,497,488 2/1985 Plevyak et al. ..... 273/149 R 4,512,580 4/1985 Matuiak ..... 273/149 R

*Primary Examiner*—Richard C. Pinkham

*Assistant Examiner*—Leo P. Picard

*Attorney, Agent, or Firm*—Lerner, David, Littenberg, Krumholz & Mentlik

[57] ABSTRACT

A method and apparatus for the continous shuffling of discarded playing cards is disclosed which greatly reduces the dead time caused by the casino dealer having to manually shuffle four to six decks of playing cards, in addition, to virtually eliminating a participant from using the technique known as card counting while playing the game of blackjack. The shuffling apparatus continuously intermixes the discarded playing cards into the undealt decks during game play under the program control of a computer. An addressable storage device, i.e., a carousel, for storing the shuffled playing cards in radially arranged spaces during game play is provided. The computer generates random card selection from the spaces of the storage device for replenishing dealing shoe storage on a one-for-one basis and generates random selection of empty spaces in the storage device for generating the shuffling sequence in inserting discarded playing cards therein.

18 Claims, 4 Drawing Figures

AUTOMATIC SHUFFLING APPARATUS

BACKGROUND OF THE INVENTION

The present invention relates in general to a method and apparatus for shuffling playing cards and the like and, more particularly, to such a method and apparatus for the continuous shuffling of discarded playing cards into a supply of shuffled playing cards contained within a storage carousel from which playing cards to be dealt during game play may be randomly and selectively withdrawn under the programmed control of a computer or the like.

Today, there are many established forms of legal gambling wherein various types of card games require the use of several decks during game play. One of the more popular forms of gambling found at most casinos is the card game referred to as blackjack. In the game of blackjack, the dealer often uses four to eight shuffled decks from which he deals during the course of game play. The great number of individual playing cards to be handled makes it almost impossible to shuffle these four to eight decks in one single operation. In addition, there is also the difficulty in providing complete randomness to the individual playing cards such that the cards cannot be dealt in the same order or sequence as in the previous game play. To this end, most casinos have established a shuffling routine for these decks to insure their complete randomness before being used for the next game play. However, this shuffling routine is often time consuming such that approximately fifteen percent of game play is considered nonplayable dead time. As a result of this dead time, a considerable loss in gambling revenue is denied to the casinos, as well as, significant interruption in game play for the participants.

Further, the often used casino procedure of continuously dealing cards during game play until the four to eight decks are exhausted before reshuffling the discarded cards has resulted in the use by the participants of a technique commonly referred to as card counting. This technique of card counting has been of great concern to the casinos as potentially giving the participant in the game of blackjack an unfair advantage during certain periods of game play. In fact, this problem has been considered so serious by the casinos that often a participant who is suspected of card counting is often banned from the casino. In consideration of the foregoing, there is disclosed in U.S. Pat. Nos. 4,310,160 and 3,589,730 devices for shuffling playing cards and the like. However, these prior art card shuffling devices are not adaptable for providing the necessary randomness when shuffling four to eight decks of discarded playing cards as required by the casinos or of preventing the aforementioned problem of card counting in the game of blackjack.

Accordingly, it can be appreciated that there is an unsolved need for a method and apparatus for the continuous shuffling of discarded playing cards which signficantly reduces the dead time encountered in the traditional shuffling of four to eight decks by the dealer and which makes card counting in the game of blackjack by the participant virtually impossible.

SUMMARY OF THE INVENTION

It is broadly an object of the present invention to provide a method and apparatus for continuously shuffling of playing cards which overcomes or avoids one or more of the foregoing disadvantages resulting from the use of the above-mentioned prior art card shuffling devices and, which fulfills the requirements for such a method and apparatus for shuffling discarded playing cards during the casino game of blackjack. Specifically, it is within contemplation of one aspect of the present invention to provide a method and apparatus for continuously shuffling discarded playing cards which greatly reduces the dead time caused by the dealer having to manually shuffle four to eight decks of cards, in addition, to virtually eliminating a participant from using the technique known as card counting while playing the game of blackjack.

A further object of the present invention is to provide a method and apparatus for continuously shuffling discarded playing cards into the undealt decks during game play.

A still further object of the present invention is to provide a method and apparatus for continuously shuffling discarded playing cards to achieve total randomness irrespective of the number of decks being used by the casino and without interruption of game play.

A still further object of the present invention is to provide a method and apparatus for continuously shuffling playing cards under the programmed control and operation of a computer.

A still further object of the present invention is to provide a method and apparatus for continuously shuffling playing cards which can be programmed to operate in a variety of predetermined operating modes.

In accordance with one embodiment of the present invention there is provided an apparatus for continuously shuffling playing cards comprising a container for receiving playing cards to be shuffled, a storage device for storing shuffled playing cards, shuffling means for intermixing the playing cards in the container with the shuffled playing cards in the storage device, a dealing shoe for receiving the shuffled playing cards from the storage device to be dealt therefrom, and supplying means for supplying the shuffled playing cards from the storage device to the dealing shoe.

In accordance with the above embodiment, the storage device comprises a carousel having a plurality of radially arranged addressable spaces for individually storing the shuffled playing cards. Further, the shuffling means comprises removing means for removing the playing cards from the container and inserting means for inserting the removed playing cards into empty spaces of the carousel. Still further, the supplying means comprises ejecting means for ejecting the shuffled playing cards from filled spaces within the carousel and inserting means for inserting the ejected shuffled playing cards into the dealing shoe.

In accordance with another embodiment of the present invention there is provided a method for continuously shuffling playing cards comprising the steps of receiving in a container playing cards to be shuffled, storing shuffled playing cards in a storage device, intermixing the playing cards in the container with the shuffled playing cards in the storage device and, supplying the shuffled playing cards from the storage device to a dealing shoe to be dealt therefrom.

In accordance with the last mentioned embodiment, the intermixing step includes removing the playing cards from the container and inserting the removed playing cards into the shuffled playing cards within the storage device. Further, the supplying step includes ejecting the shuffled playing cards from the storage device and inserting the ejected shuffled playing cards into the dealing shoe.

BRIEF DESCRIPTION OF THE DRAWINGS

The above description, as well as further objects, features and advantages of the present invention, will be more fully understood by reference to the following detailed description of a presently preferred, but nonetheless illustrative automatic shuffling apparatus in accordance with the present invention when taken in conjunction with the accompanying drawings, wherein.

DETAILED DESCRIPTION

Figure 1:
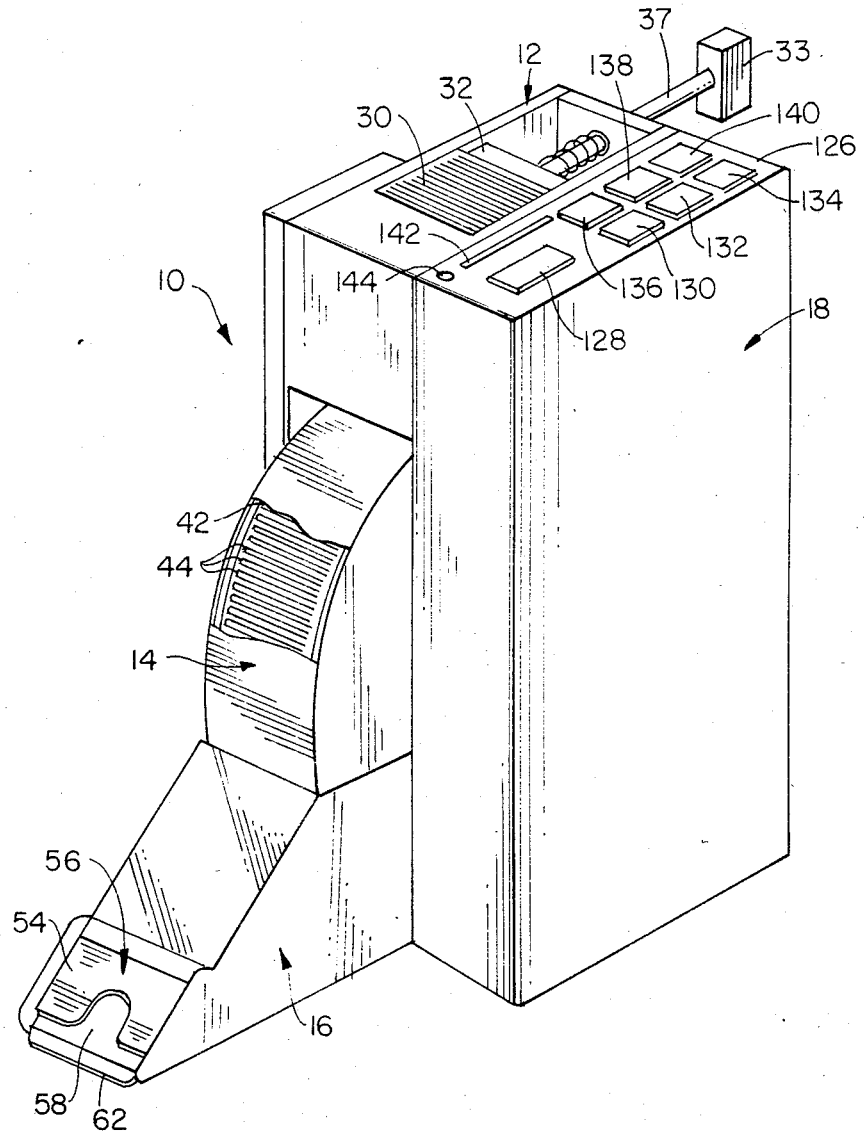
FIG. 1 is a perspective view of the automatic shuffling apparatus constructed of a container for receiving playing cards to be shuffled, a storage device, i.e., a carousel, for storing shuffled playing cards, a dealing shoe for receiving shuffled playing cards from the storage device to be dealt therefrom and control means for controlling the operation of the shuffling and supplying means.
Figure 2:
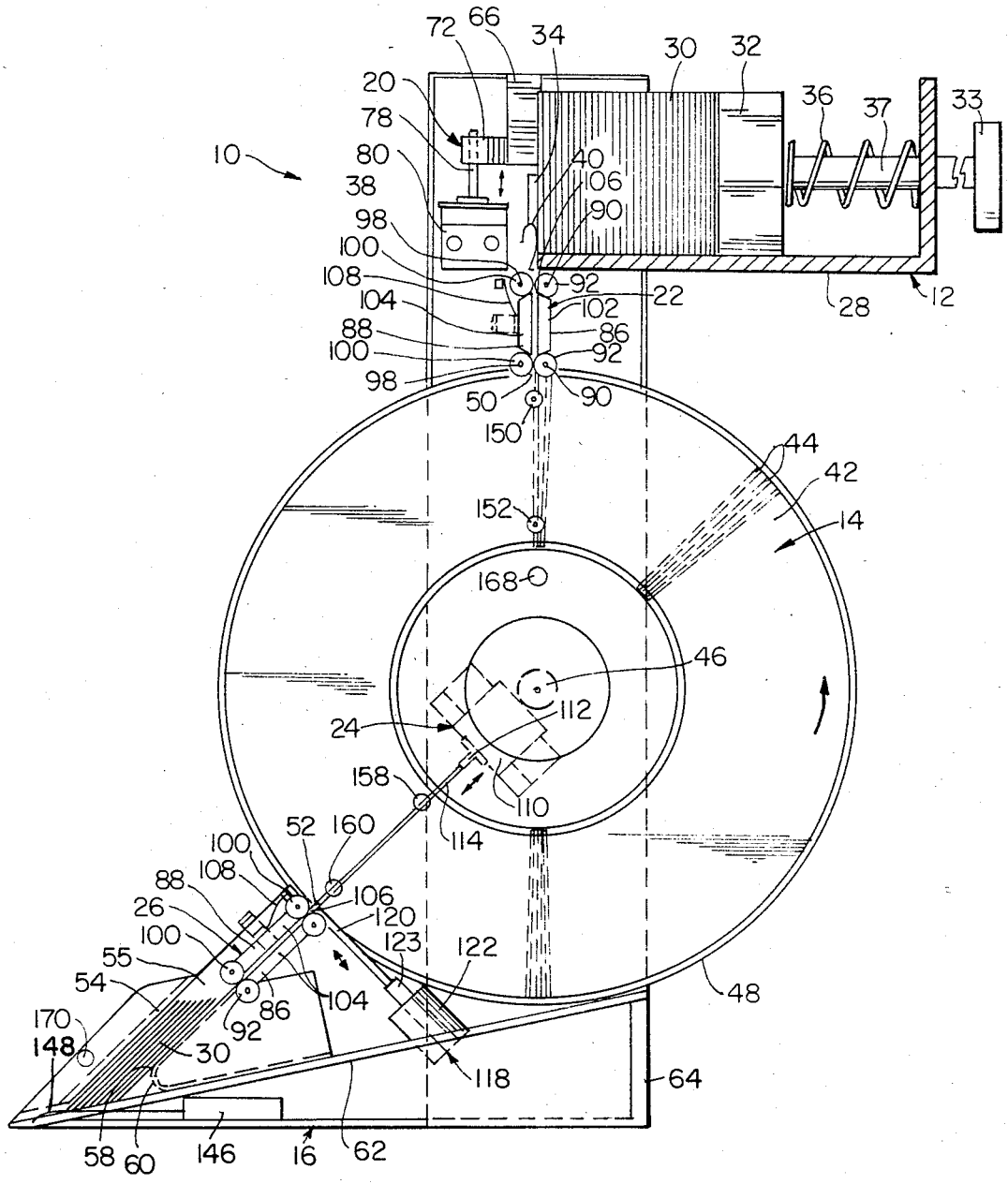
FIG. 2 is a partial cross-sectional side elevation of the automatic shuffling apparatus showing the shuffling means constructed of removing means for removing the playing cards from the container and inserting means for inserting the removed playing cards into randomly selected empty spaces of the carousel and the supplying means constructed of ejecting means for ejecting the shuffled playing cards from randomly selected filled spaces within the carousel and inserting means for inserting the ejected playing cards into the dealing shoe.

Referring specifically to the drawings in which like reference characters represent like elements, there is shown in FIG. 1 an automatic shuffling apparatus generally designated by reference character 10 and adapted for the continuous shuffling of discarded playing cards into undealt decks during game play. The shuffling apparatus 10 is constructed to include a container 12 for receiving discarded playing cards to be shuffled during game play, a storage device 14 for storing shuffled playing cards, a dealing shoe 16 for receiving shuffled playing cards from the storage device to be dealt therefrom and a control module 18 for controlling the operation of the shuffling apparatus. Referring to FIG. 2, the shuffling apparatus 10 further includes a shuffling assembly constructed of a card removing device 20 arranged adjacent the container 12 for individually removing discarded playing cards from the container and a card inserting device 22 arranged underlying the container for individually inserting in a random manner the removed playing cards into the storage device 14. Further, the shuffling apparatus 10 includes a supplying assembly constructed of a card ejecting device 24 arranged within a central portion of the storage device 14 for individually ejecting in a random manner the shuffled playing cards from the storage device and a card inserting device 26 arranged underlying the storage device for individually inserting the ejected shuffled playing cards into the dealing shoe 16.

There will now be described in greater detail the construction of the container 12, storage device 14, dealing shoe 16, control module 18, removing device 20 inserting devices 22, 26 and ejecting device 24 with specific reference to FIGS. 2, 3 and 4. The container 12 is constructed from a housing 28 adapted to receive any number of playing cards 30 to be shuffled. For example, the container 12 can be constructed of sufficient size to receive anywhere from four to eight decks of playing cards 30 to be randomly shuffled as is typically required of casino blackjack play. However, the container 12 can obviously be sized to receive any number of decks of playing cards to be shuffled as desired by the casino. A pusher bar 32 having a handle 33 is slidably arranged within the container 12 for biasing the playing cards 30 against a retaining wall 34 by a spring 36 arranged around the shaft 37 of the pusher bar. Adjacent the retaining wall 34 and along a forward bottom portion of the housing 28 is an opening 38 in the form of a slot of sufficient size to allow for the individual removal of the foremost playing card 30 from the container 12. One or more leaf springs 40 are secured adjacent the retaining wall 34 and extending within the opening 38 for maintaining the orientation of the foremost playing card 30 as it passes through the opening upon being removed from the container 12.

The storage device 14 as shown in FIG. 2 is constructed of a circular carousel 42 having a plurality of radially arranged addressable spaces 44 for individually storing shuffled playing cards 30. The carousel 42 is rotationally mounted about a horizontal shaft 46 for stepwise rotation, by stepper motor 47 having 1.8° steps within a stationary outer shell 48. The outer shell 48 is vertically mounted between the container 12 and dealing shoe 16 and has a first opening 50 in the form of a slot arranged in alignment with the opening 38 of the container and a second opening 52 in the form of a slot arranged in alignment with the inserting device 26 within the dealing shoe.

Figure 3:
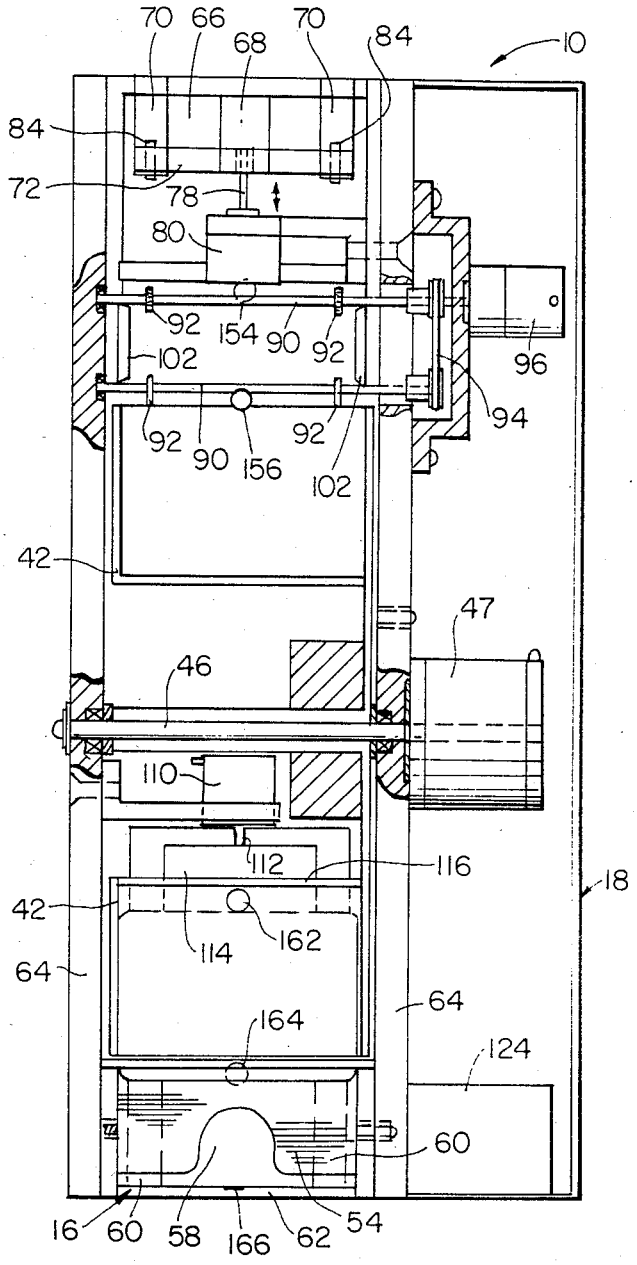
FIG. 3 is a partial cross-sectional front elevation of the automatic shuffling apparatus showing the control means including a computer for controlling the operation of the shuffling and supplying means; and, FIG. 4 is a top elevation of the automatic shuffling apparatus having a section partially removed showing the construction of the removing means from a reciprocating E-shaped member.
Figure 4:
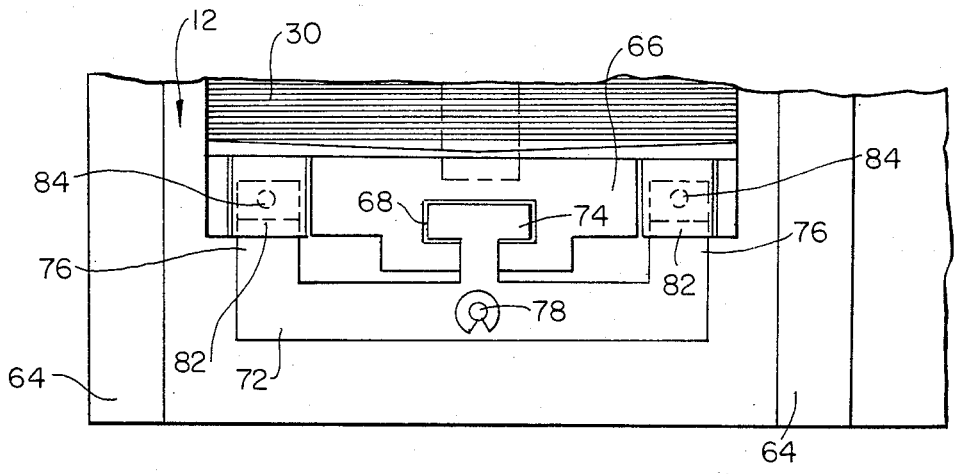

The dealing shoe 16 as shown in FIGS. 2 and 3 is generally constructed in accordance with those known dealing shoes presently being employed in various casinos except for certain differences which are to be described herein. Generally, the dealing shoe 16 is constructed of a cover 54 removably positioned within an opening 56 provided at the frontmost portion of the dealing shoe. The cover 54 is arranged remote from a playing card supporting wall 58 to provide a space 55 for retaining a plurality of playing cards 30 therein. The retained playing cards 30 within the space 55 are biased against the inside of the cover 54 by one or more leaf springs 60 arranged adjacent the supporting wall 58. The playing cards 30 are further supported within the space 55 of the dealing shoe 16 along their bottom edge by an inclined ramp 62. The dealing shoe 16 is arranged generally underlying the storage device 14 with the supporting wall 58 being in linear alignment with the inserting device 26 of the second opening 52 within the outer shell 48 of the storage device. As illustrated, the container 12, storage device 14 and dealing shoe 16 are arranged and mounted in operative association with one another between a pair of supporting frame members 64.

The shuffling assembly constructed from a removing device 20 and inserting device 22 will now be described in greater detail with specific reference to FIGS. 2, 3 and 4. The removing device 20 includes a slide member 66 having a T-shaped slot 68 centered between a pair of vertically extending openings 70 provided therein. An E-shaped feeder arm 72 includes a complimentary T-shaped center leg 74 adapted to be slidingly received within the T-shaped slot 68 and a pair of end legs 76 arranged in alignment with and extending into the openings 70. The feeder arm 72 is secured to the end of a shaft 78 connected to a digital linear actuator or solenoid 80 for vertical reciprocal movement of the feeder arm within the T-slot 68 and openings 70. Resilient end caps 82 are removably secured by pins 84 to the end legs 76 for engagement through the openings 70 with the foremost playing card 30 within the container 12.

The inserting device 22 is arranged underlying the container 12 in linear alignment with the opening 38 provided within the housing 28 and the first opening 50 provided within the outer shell 48 of the storage device 14 thereby preventing any bending of the playing cards 30 being moved therebetween. The inserting device 22 includes a fixed roller assembly 86 and a floating roller assembly 88. The fixed roller assembly 86 includes a pair of parallel spaced axles 90 each having a pair of driver rollers 92 secured thereon. The axles 90 are journeled to the supporting frame members 64 and have a common end linked together by a drive belt 94 to cause rotation of the driver rollers 92 upon operation of a reduction gear box and micromotor 96 attached thereto. The floating roller assembly 88 is of like construction to the fixed roller assembly 86, namely including a pair of parallel spaced axles 98 supporting spaced apart driven rollers 100 with the axles being journaled to the supporting frame members 64.

The floating roller assembly 88 is positioned adjacent the fixed roller assembly 86 such that the driven rollers 100 are in contact with the driver rollers 92 whereby the nips formed therebetween are in alignment with the opening 38 of the container 12 and the first opening 50 in the outer shell 48 of the storage device 14. Spaced apart pairs of guides 102, 104 are secured outwardly of the driver rollers 92 and driven rollers 100 between corresponding axles 90, 98. The guides 102, 104 are secured to the axles 90, 98 by suitable means (not shown) such as by use of snap type retaining rings and flat washers. The guides 102, 104 are arranged opposing each other to form a narrow slit 106 through which playing cards 30 from the container 12 pass through. The floating roller assembly 88 is urged against the fixed roller assembly 86 by one or more leaf springs 108 whereby cards 30 are prevented from bending and are provided with a smooth sliding fit upon passage through the inserting device 22.

The ejecting device 24 is arranged within a central hollow portion of the storage device 14 and includes a digital linear actuator or solenoid 110 having a shaft 112 secured to a flat ejecting blade 114. The ejecting blade 114 is adapted to be reciprocally inserted into the spaces 44 of the carousel 42 through openings 116 (see FIG. 3) provided within the interior wall of the carousel 42 for engagement with playing cards 30 therein.

The inserting device 26 is constructed identically to the previously described inserting device 22 and will accordingly not be repeated hereat. The inserting device 26 is arranged adjacent the storage device 14 such that the nips formed between the driver rollers 92 and driven rollers 100 are in linear alignment with the second opening 52 in the outer shell 48 of the storage device and with the last playing card 30 within the dealng shoe 16 adjacent the supporting wall 58 thereby preventing any bending of the playing cards 30 as they are being moved therebetween. A closing device 118 is positioned within the dealing shoe 16 and includes a gate 120 secured to a solenoid 122 by a shaft 123. The closing device 118 is arranged such that the slide gate 120 is reciprocally operable between the inserting device 26 and the outer shell 48 of the storage device 14 for closing the second opening 52 within the outer shell to prevent the ejecting of playing cards 30 therethrough until desired.

The control module 118 is generally constructed to include a computer 124, microprocessor or the like adapted for controlling the operation of the solenoid 80 of the removing device 20, the motor 96 of the inserting device 22, the stepper motor 47 of the storage device 14, the solenoid 110 of the ejecting device 24, the solenoid 122 of the closing device 118 and the motor (not shown) of the inserting device 26. For example, one such computer is a Commodore VIC-20. The control module 18 includes a control panel 126 provided with a number of switches and lamps, namely a stop switch 128, a start switch 130, a load switch 132, a empty switch 134, a card jam light indicator 136, a ready light indicator 138, a tray empty light indicator 140, a cumulative card count indicator 142 and an on/off light 144. In addition, the computer 124 is responsive in controlling the operation of the shuffling apparatus 10 to a micro switch 146 having an actuator arm 148 provided in the dealing shoe 16 and a plurality of photocells and detectors arranged throughout the shuffling apparatus as to be more fully described hereinafter.

Having thus far described the details of the construction of the automatic shuffling apparatus 10 in accordance with the present invention, there will now be briefly described the method of operation of the shuffling apparatus in accordance with one embodiment. Initially, all of the playing cards, e.g., four to eight decks, are placed within the container 12 as illustrated where they are biased against the retaining wall 34 by operation of the pusher bar 32. The solenoid 80 is activated to cause reciprocal vertical movement of the feeder arm 72 within the openings 70 whereby the foremost playing card 30 in the container 12 is engaged by the end caps 82 and moved downward through the opening 38 within the housing 28 and into engagement with the inserting device 22 at the nips formed between the driver rollers 92 and the driven rollers 100. The playing card 30 is pulled through the inserting device 22 via rotation of the driver rollers 92 against the driver rollers 100 and inserted through the first opening 50 in the outer shell 48 into the storage device 14. The stepper motor 47 is incrementally stepped, for example, 1.8° per step for sequentially positioning empty spaces 44 selected by the computer 124 into alignment with the first opening 50 to receive an incoming playing card. In this manner, each of the playing cards 30 from the container 12 are individually removed and inserted into the computer 124 selected empty spaces 44 within the carousel 42.

A predetermined number of playing cards 30 within the filled carousel 42 are randomly withdrawn by operation of the ejecting device 24 and are inserted within the dealing shoe 16. The filled spaces 44 from which playing cards 30 are to be removed are selected by the computer 124. As the ejecting blade 114 is inserted within a filled space 44 of the carousel 42 to eject a playing card 30 therefrom, the closing device 118 is operated to remove the slide gate 120 from over the second opening 52 of the outer shelf 48 of the storage device 14. As the playing card 30 is ejected through the second opening 52, the playing card is engaged by the inserting device 26 in the manner previously with respect to the inserting device 22 and supplied to the dealing shoe 16. The address of the now empty spaces 44 from which the playing cards 30 have been removed from the carousel 42 are stored in the memory in the computer 124. As a playing card 30 is being removed from the dealing shoe 16, the microswitch 146 is thrown by actuator arm 148 to activate the shuffling apparatus 10 such that the previously discarded playing cards 30 which have been returned to the container 12 are individually removed by the removing device 20 and placed randomly into an empty space 44 preselected by the computer 124 from its memory by the inserting device 22. Further, a playing card 30 is then randomly removed from one of the filled spaces 44 preselected by the computer 124 by the ejecting device 24 and inserted into the dealing shoe 16 by the inserting device 26 for continuously maintaining a desired number of playing cards within the dealing shoe. Again, the address of the now empty space 44 is stored in the memory of the computer 124. In brief summary, all the discarded playing cards 30 within the container 12 are all individually withdrawn and randomly inserted into empty spaces 44 within the carousel 42 containing the remainder of the playing cards in shuffled form under the control of the computer 124. The shuffled playing cards 30 within the carousel 42 are individually and randomly withdrawn and supplied into the dealing shoe 16 to be dealt therefrom. In this regard, discarded playing cards 30 are continuously being reshuffled into the shuffled playing cards within the carousel 42 from which playing cards are continuously and randomly withdrawn to provide a supply of playing cards within the dealing shoe 16 to be dealt during game play.

As thus far described, it will be readily appreciated that the manner of operating the automatic shuffling apparatus 10 in accordance with the present invention may be in an infinite variety of ways and sequenced in a likewise infinite variety of ways. For example, there will now be presented the sequence of operation of one specific embodiment of the method of the present invention as set forth in the following steps.

I. LOADING PROCEDURE

To be done by operator every shift or whenever a starting procedure is required:

1. Fill container 12 using pusher bar 32 with four (4) decks of cards to be used during game play.
2. Press load switch 132 upon which the shuffling apparatus 10 will now randomly load the spaces 44 of the carousel 42 with one hundred eighty four (184) cards; then the shuffling apparatus will move twenty-four (24) cards into the dealing shoe 16.
3. Ready light 138 will now come on.

II. MICROCOMPUTER LOADING PROCEDURE

A. If carousel 42 is full, see part B:

1. Check container 12 for empty, using container 12 microswitch (not shown).
2. If container 12 is not empty, proceed to step 5.
3. Light card tray empty light 136.
4. Go to step number 1.
5. Using stepper motor 47, move carousel 42 to a random empty space 44 in alignment with the first opening 50 in the outer shell 48 of the storage device 14.
6. Confirm that space 44 is empty by using photocells 150, 152.
7. If space 44 is not empty, go to error procedure.
8. Using solenoid 80 and feeder arm 72, remove card from container 12 through opening 38 and into inserting device 22 which is operating by motor 96.
9. Check photocells 154, 156 for placement of card into empty space 44 by passage through inserting device 22.
10. If photocells 154, 156 don't detect card passage, light card jam light 140 and go to error procedure.
11. Go to step number 1.

B. When carousel 42 is filled to prescribed level:

1. Go to ramdom filled spaces 44 in carousel 42 using stepper motor 47 and using photocells 158, 160 to align filled space with the second opening 52 in the outer shell 48 of the storage device 14.
2. Check space 44 to verify it contains card. If not, light card jam light 140 and go into error procedure.
3. Open slide gate 120 from covering of second opening 52 via activation of solenoid 122.
4. Using ejecting device 24, push card out into inserting device 26 by ejecting blade 114 upon activation of solenoid 110.
5. Check for card passage through the inserting device 26 using photocells 162, 164.
6. If card fails to pass, light card jam light 140, then go to error procedure.
7. When card has passed into bottom section of dealing shoe 16, repeat procedure B until twenty-four (24) cards are in the shoe.
8. Light ready light 138.

III. NORMAL OPERATION

Remove cards from dealing shoe 16 for normal play with left hand activating photocell 170 and microswitch 146 via arm 148, distributing them to the players with the right hand. When game round is over, place cards in container 12. (Follow procedure until end of shift, then go to empty procedure).

1. Check an internal card counter (not shown) triggered by photocell 166 and microswitch 146 in dealing shoe 12 for the number of cards to be replaced. Add this figure to the current card total and show on card container 142.
2. Do the following procedure until the appropriate number of cards have been replaced in the dealing shoe 12 from the carousel 42.
3. Using stepper motor 47, move the carousel 42 to a random empty space 44 in alignment with the first opening 50 in the outer shell 48 of the storage device 14.
4. Confirm that space 44 is empty by using photocells 150, 152.
5. If space 44 is not empty, go to error procedure.
6. Using solenoid 80 and feeder arm 72, remove card from container 12 through opening 38 and into inserting device 22 which is operating by motor 96.
7. Check photocells 154, 156 for placement of card into empty space 44 by passage through inserting device 22.
8. If photocells 154, 156 don't detect card passage, light card jam light 140 and go to error procedure.
9. Go to random filled space 44 in carousel 42 using stepper motor 47 and using photocells 158, 160 to align empty space with the second opening 52 in the outer shell 48 of the storage device 14.

10. Check space 44 to verify it contains card. If not, light card jam light 140 and go into error procedure.
11. Open slide gate 120 from covering second opening 52 via activation of solenoid 122.
12. Using ejecting device 24, push card out into inserting device 26 by ejecting blade 114 upon activation of solenoid 110.
13. Check for card passing through the inserting device 26 using photocells 162, 164.
14. If card fails to pass light card jam light 140, then go to error procedure.
15. When card has passed into dealing shoe 16, go to step number 2.
16. After appropriate number of cards have been processed, go to step number 1.

IV. EMPTY PROCEDURE

To be done at the end of each shift or whenever the shuffling apparatus 10 is to be emptied of all cards.

A. Operator Instructions:

1. Open the dealing shoe 16 by taking off removable cover 154.
2. Press the empty switch 134.
3. The shuffling apparatus 10 will now empty all cards in the carousel 42 into the dealing shoe 42.

B. Microcomputer Information:

After the empty switch 154 has been pressed, the following will happen:

1. Check removable cover 154 to verify that cover has been removed. If not, go to error procedure.
2. Go to next filled space 44 in the carousel 42 using stepper motor 47.
3. Open slide gate 120 from covering of second opening 52, via activation of solenoid 122.
4. Using ejecting device 24, push cards out into inserting device 26 by ejecting blade 114 upon activation of solenoid 110.
5. Check for card passage through the inserting device 26 using photocells 162, 164.
6. If card fails to pass, light card jam light 140 and go to error procedure.
7. When card has passed into dealing shoe 16, repeat this procedure until all cards in carousel 42 have been emptied.
8. Light ready light 138.

V. ERROR PROCEDURES

A. Operator Procedure:

Error procedure is executed in one of two ways. If the card jam light 140 is lit or manually operated. To initiate error procedure manually, press stop switch 128. Card jam light 140 will then come on.

1. Identify source of problem and fix (i.e. remove jammed card replace card in container, etc.)
2. Push start switch 130.
3. Wait for ready light 138 before continuing normal operation.

B. Microcomputer Instructions:

1. Rotate carousel 42 so a space 44 is in line with photocells 150, 152. This is done by referring to reflective reference dot on the inner ring of the carousel using optical switch 168.
2. Using photocells 150, 152, determine status of the current space 44.
3. Record the status of the space 44 in the memory of the computer 124, i.e., whether the space 44 is empty or full.
4. Move to next sequential space 44 using stepper motor 47.
5. Repeat steps 2, 3, and 4 until the status of all 200 spaces 44 is recorded in the memory of the computer 124.
6. Continue with the operation that was being performed prior to the detection of the error.

In accordance with the present invention there has thus far been described in automatic apparatus for the continuous shuffling of playing cards comprising a container for receiving discarded playing cards to be shuffled, the container having an exit opening through which the discarded playing cards may be individually removed, a storage device for storing shuffled playing cards, the storage device having a first opening for receiving the discarded playing cards from the container and a second opening through which the shuffled playing cards are individually ejected, shuffling means for intermixing the discarded playing cards in the container with the shuffled playing cards in the storage device, the shuffling means including removing means for removing the discarded playing cards from the container through the exit opening and inserting means for inserting the removed playing cards into the storage device through the first opening, a dealing shoe for receiving the shuffled playing cards from the storage device to be dealt therefrom, supplying means for supplying the shuffled playing cards from the storage device to the dealing shoe, the supplying means including ejecting means for individually ejecting the shuffled playing cards through the second opening of the storage device and inserting means for inserting the ejected shuffled playing cards into the dealing shoe and, control means for controlling the operation of the shuffling and supplying means.

Further in accordance with the present invention there has been described a method for the continuous shuffling of playing cards comprising the steps of receiving in a container discarded playing cards to be shuffled, the container having an exit opening through which the discarded playing cards may be individually removed, storing shuffled playing cards in a storage device, the storage device having a first opening for receiving the discarded playing cards from the container and a second opening through which the shuffled playing cards can be individually ejected, intermixing the discarded playing cards in the container with the shuffled playing cards in the storage device, the shuffling including removing the discarded palying cards from the container through the exit opening and inserting the removed playing cards into the storage device through the first opening, receiving the shuffled playing cards from the storage device in a dealing shoe to be dealt therefrom, the supplying including individually ejecting the shuffled playing cards through the second opening of the storage device and inserting the ejected playing cards into said dealing shoe and, controlling the operation of the shuffling and supplying means.

Although the invention herein has been described as reference to particular embodiments, it is to be understood that these embodiments are merely illustrative of the principals and application of the present invention. For example, the carousel 42 may be oriented in a horizontal position having the spaces 44 arranged at about a 45° angle to be in linear alignment with the inserting device 26 in the dealing shoe 16. Alternatively, the carousel 42 may be arranged at about a 45° angle having the spaces 44 normally arranged therein to accomplish the same linear alignment. In this regard, the playing cards 30 are transferred along a linear path between the container 12 and the storage device 14 and between the storage device and dealing shoe 16 to prevent bending of the playing cards.

It is therefore to be understood that numerous modifications may be made in the illustrative embodiment and that other arrangements may be devised without departing from the spirit and scope of the present invention as defined by the appended claims.

What is claimed is:

1. An apparatus for continuously shuffling playing cards comprising a container for receiving playing cards to be shuffled, rotatably mounted storage means having a plurality of radially arranged spaces for individually storing shuffled playing cards, a stationary outer shell enclosing said storage means and having first and second openings each arranged in alignment with one of said spaces, shuffling means for randomly inserting through said first opening in said outer shell said playing cards in said container into empty spaces in said storage means, a dealing shoe for receiving said shuffled playing cards from said storage means, and supplying means for randomly supplying said shuffled playing cards from filled spaces in said storage means through said second opening in said outer shell to said dealing shoe.

2. The apparatus as set forth in claim 1 further including control means for controlling the operation of said shuffling and supplying means.

3. The apparatus as set forth in claim 2 wherein said control means comprises a computer.

4. The apparatus as set forth in claim 1 wherein said storage means comprises a carousel.

5. The apparatus as set forth in claim 4 wherein said supplying means comprises ejecting means for ejecting said shuffled playing cards from filled spaces within said carousel and inserting means for inserting the ejected shuffled playing cards into said dealing shoe.

6. The apparatus as set forth in claim 5 wherein said ejecting and inserting means are arranged for ejecting and inserting said shuffled playing cards from said storage means and into said dealing shoe along a linear path in alignment with said shuffled playing cards in said dealing shoe.

7. The apparatus as set forth in claim 1 wherein said shuffling means comprises removing means for removing said playing cards from said container and inserting means for inserting the removed playing cards into empty spaces of said carousel.

8. The apparatus as set forth in claim 7 wherein said removing and inserting means are arranged for removing and inserting said playing cards from said container and into said carousel along a linear path in alignment with an adjacent empty space of said carousel.

9. An automatic apparatus for the continuous shuffling of playing cards comprising a container for receiving discarded playing cards to be shuffled, said container having an exit opening through which said discarded playing cards may be individually removed, a storage device having a plurality of radially arranged individually addressable spaces for storing said shuffled playing cards, a stationary outer shell enclosing said storage device, said outer shell having a first opening in alignment with said exit opening of said container for receiving said discarded playing cards from said container and a second opening through which said shuffled playing cards are individually ejected, shuffling means for randomly inserting said discarded playing cards in said container into said shuffled playing cards in said storage device, said shuffling means including removing means for removing said discarded playing cards from said container through said exit opening and inserting means for inserting the removed playing cards into selected empty spaces of said storage device through said first opening in said outer shell, a dealing shoe for receiving said shuffled playing cards from filled spaces in said storage device to be dealt therefrom, supplying means for supplying said shuffled playing cards from said storage device to said dealing shoe, said supplying means including ejecting means for individually ejecting said shuffled playing cards through said second opening of said storage device and inserting means for inserting the ejected shuffled playing cards into said dealing shoe, and control means for controlling the operation of said shuffling and supplying means, wherein the addresses of said spaces are maintained by said control means.

10. The apparatus as set forth in claim 9 wherein said storage device comprises a carousel.

11. The apparatus as set forth in claim 10 further including indexing means for indexing said carousel to a predetermined empty space of said carousel and into linear alignment with said shuffling means, the address of said empty space being randomly selected from said memory of said control means.

12. The apparatus as set forth in claim 9 further including closing means for closing said second opening in said storage device to prevent the ejecting of said shuffled playing cards therethrough.

13. The apparatus as set forth in claim 9 further including biasing means for biasing said discarded playing cards into operative engagement with said removing means.

14. The apparatus as set forth in claim 9 wherein said removing means includes a feeder arm having outwardly extending legs for engaging said discarded playing card to be removed from said container through said exit opening.

15. The apparatus as set forth in claim 9 wherein said ejecting means includes a blade secured to a solenoid to be reciprocally inserted into said storage device for ejecting said shuffled playing cards through said second opening.

16. The apparatus as set forth in claim 9, wherein said removing and inserting means includes opposed pairs of rollers forming a nip therebetween to engage said playing cards therein.

17. A playing card dispenser comprising in combination: a rotatably mounted storage means having a plurality of compartments for holding said playing cards, a stationary outer shell enclosing said storage means and having first and second openings each arranged in alignment with one of said compartments, first means for randomly inserting discards into selected ones of said compartments through said first opening in said outer shell, and second means for randomly extracting cards to be dealt from said selected compartments through said second opening in said outer shell, whereby said playing cards are effectively being shuffled continuously by the random insertion or extraction from said storage means.

18. A dispenser in accordance with claim 17 further including means for randomly controlling one of said first and second means.

* * * * *

UNITED STATES PATENT AND TRADEMARK OFFICE

CERTIFICATE OF CORRECTION

PATENT NO. : 4,586,712

DATED : May 6, 1986

INVENTOR(S) : Harold Lorber, et al.

It is certified that error appears in the above-identified patent and that said Letters Patent are hereby corrected as shown below:

Column 5, line 66, change "dealng" to --dealing--.

Column 6, line 2, after "a" insert --slide--.

Column 8, line 46, change "container" to --counter--.

Column 10, line 49, change "palying" to --playing--.

Signed and Sealed this

*Thirtieth* Day of *September 1986*

[SEAL]

*Attest:*

*Attesting Officer*

DONALD J. QUIGG

*Commissioner of Patents and Trademarks*